US007604195B1

(12) United States Patent
Lai

(10) Patent No.: US 7,604,195 B1
(45) Date of Patent: Oct. 20, 2009

(54) STRAPPING HEAD ASSEMBLY FOR A WRAPPING MACHINE

(76) Inventor: Chien-Fa Lai, No. 56, Industry 35 Rd., Hsi-Tun Dist., Taichung (TW)

( * ) Notice: Subject to any disclaimer, the term of this patent is extended or adjusted under 35 U.S.C. 154(b) by 0 days.

(21) Appl. No.: 12/128,685

(22) Filed: May 29, 2008

(51) Int. Cl.
*B65H 23/04* (2006.01)

(52) U.S. Cl. ..... 242/396.5; 242/130.2; 242/591; 242/597.7

(58) Field of Classification Search ..... 242/421, 242/421.8, 396.5, 406, 559.4, 597.7, 590, 242/591, 129.8, 130.2, 156
See application file for complete search history.

(56) References Cited

U.S. PATENT DOCUMENTS 3,721,394 A * 3/1973 Reiser ..... 242/421.3
4,102,513 A * 7/1978 Guard ..... 242/423.1
4,714,211 A * 12/1987 Hwang ..... 242/423.1
4,738,385 A * 4/1988 Bell ..... 225/106
5,297,750 A * 3/1994 Hunt ..... 242/422.4
5,911,376 A * 6/1999 Scaglia ..... 242/118.32
7,140,573 B1 * 11/2006 Jerstroem et al. ..... 242/597.3
7,264,197 B2 * 9/2007 Yu ..... 242/597.7
2002/0070308 A1 * 6/2002 Fahringer ..... 242/423.2

* cited by examiner

*Primary Examiner*—Sang Kim
(74) *Attorney, Agent, or Firm*—Alan Kamrath; Kamrath & Associates PA

(57) ABSTRACT

A strapping head assembly has a central axle, a braking tube, a lower securing plate, a braking pad, an adjusting base, a biasing member, an adjusting nut, a strap-holding collar and an upper holding base. The braking tube is mounted rotatably around the central axle. The lower securing plate is mounted on the bottom of the braking tube. The braking pad is attached to the top of the braking tube. The adjusting base is adjustably mounted on the central axle and abuts with the braking pad. The biasing member is mounted around the central axle and abuts against the adjusting base. The adjusting nut is screwed with the central axle and abuts with the biasing member. The strap-holding collar is mounted around the central axle. The upper holding base is mounted around the central axle and has an abutting flange mounted over the strap-holding collar.

20 Claims, 4 Drawing Sheets

STRAPPING HEAD ASSEMBLY FOR A WRAPPING MACHINE

BACKGROUND OF THE INVENTION

1. Field of the Invention

The present invention relates to a strapping head assembly, and more particularly to a strapping head assembly for a wrapping machine.

2. Description of Related Art

A wrapping machine is used to strap objects or packages with straps and substantially comprises a base and a strapping head assembly around which a strap roll is mounted. The strapping head assembly is rotatably mounted on the base, the strap of the strap roll will be released from the strapping head assembly to strap objects.

To fit with different straps with different thicknesses, the strapping head assembly is adjustable in tightening strength provided to the straps. However, structure of a conventional strapping head assembly is complicated, to adjust the conventional strapping head assembly for different tightening strengths is difficult and laborious.

To overcome the shortcomings, the present invention tends to provide a strapping head assembly to mitigate or obviate the aforementioned problems.

SUMMARY OF THE INVENTION

The main objective of the invention is to provide a strapping head assembly that is easily adjusted to fit with different straps and is versatile and convenient in use.

The strapping head assembly has a central axle, a braking tube, a lower securing plate, a braking pad, an adjusting base, a biasing member, an adjusting nut, a strap-holding collar and an upper holding base. The central axle has a top, a bottom and a thread formed on the top. The braking tube is mounted rotatably around the central axle and has a top and a bottom. The lower securing plate is mounted on the bottom of the braking tube. The braking pad is attached to the top of the braking tube and has a top. The adjusting base is adjustably mounted on the central axle and has a top and a bottom abutting with the top of the braking pad. The biasing member is mounted around the top of the central axle and has a top and a bottom abutting against the top of the adjusting base to provide a biasing force to the adjusting base. The adjusting nut is screwed with the thread on the top of the central axle and abuts with the top of the biasing member. The strap-holding collar is mounted around the top of the central axle. The upper holding base is mounted around the top of the central axle and has an abutting flange formed around and protruding from the upper holding base and mounted over the strap-holding collar.

Other objects, advantages and novel features of the invention will become more apparent from the following detailed description when taken in conjunction with the accompanying drawings.

DETAILED DESCRIPTION OF PREFERRED EMBODIMENT

Figure 1:
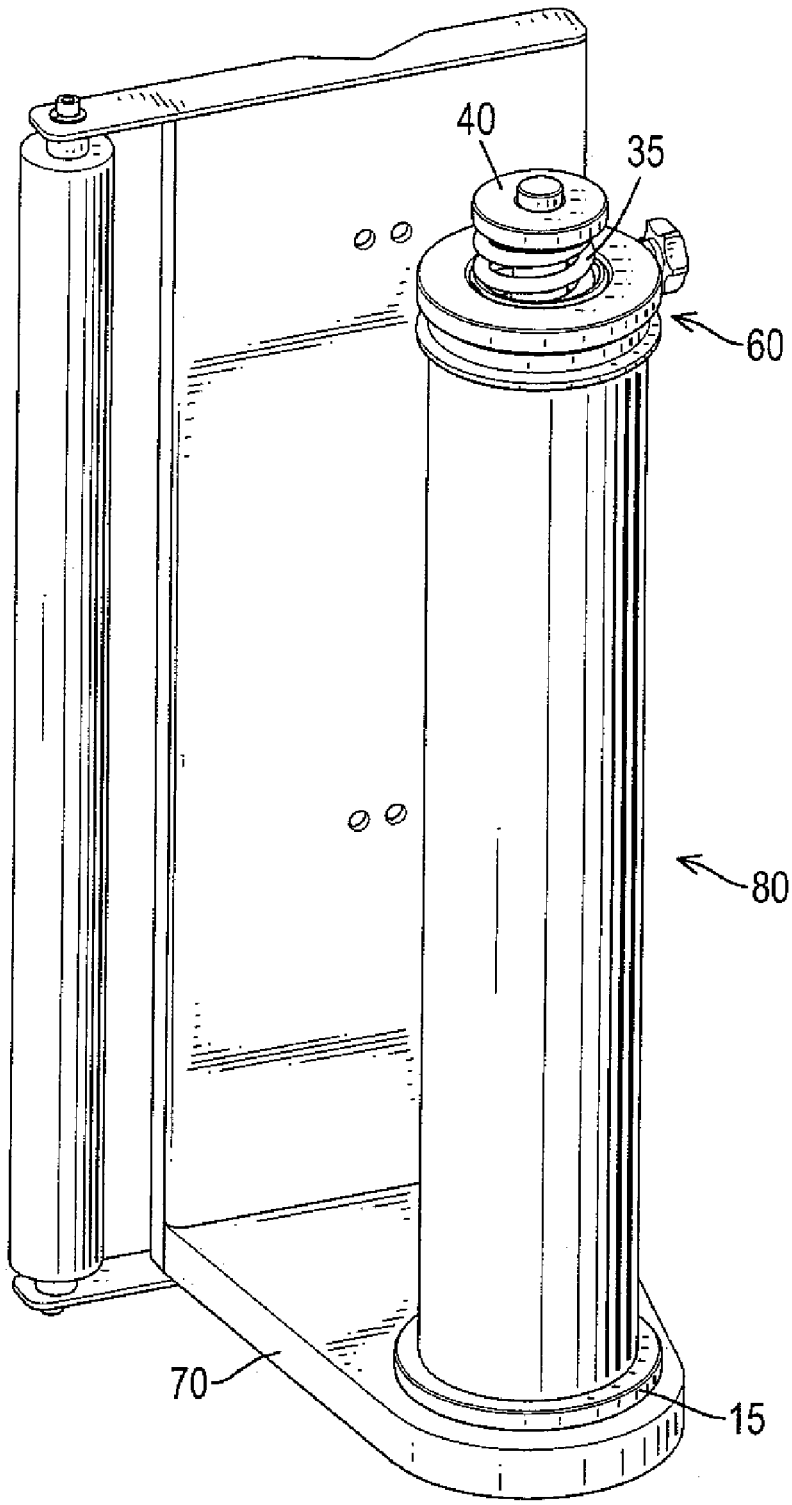
FIG. 1 is a perspective view of a strapping head assembly in accordance with the present invention mounted on a base of a wrapping machine.
Figure 2:
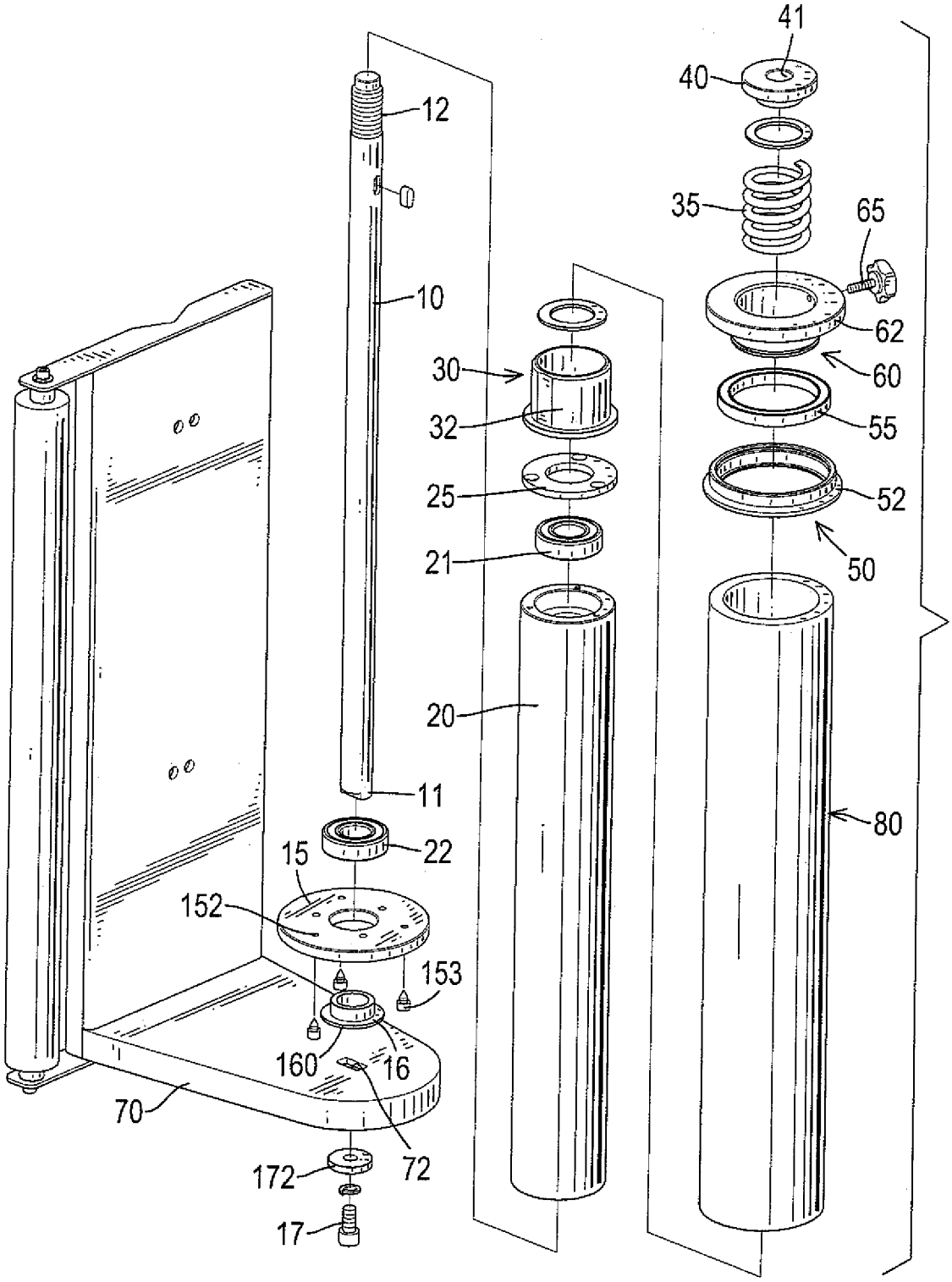
FIG. 2 is an exploded perspective view of the strapping head assembly with the base in FIG. 1.
Figure 3:
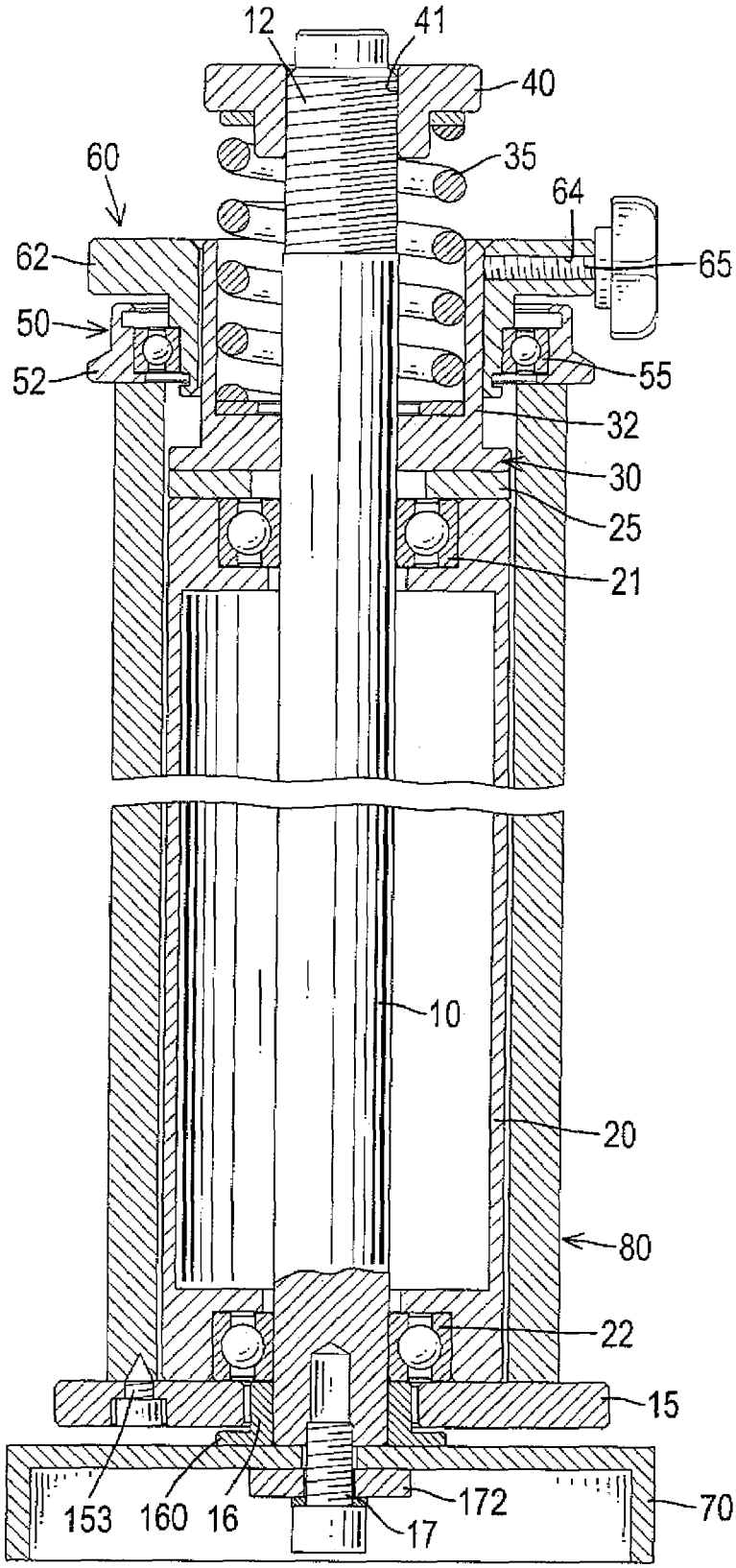
FIG. 3 is a side view in partial section of the strapping head assembly with the base in FIG. 1.

With reference to FIGS. 1 to 3, a strapping head assembly for a wrapping machine in accordance with the present invention comprises a central axle (10), a braking tube (20), a lower securing plate (15), a braking pad (25), an adjusting base (30), a biasing member (35), an adjusting nut (40), a strap-holding collar (50) and an upper holding base (60).

The central axle (10) is securely mounted on a base (70) of the wrapping machine and has a top, a bottom, a thread (12), an engaging block (11), a fastener (17) and a washer (172).

The thread (12) is formed on the top of the central axle (10). The engaging block (11) is formed on and axially protrudes from the bottom of the central axle (10) and engages an engaging hole (72) defined in the base (70). The fastener (17) extends through the washer (172) and the engaging hole (72) in the base (70) and is screwed into the bottom of the central axle (10), such that the central axle (10) is securely mounted on the base (70).

The braking tube (20) is mounted rotatably around the central axle (10) and has a top, a bottom and two bearings (21,22). Two bearings (21,22) are mounted around the central axle (10) respectively at the top and bottom of the braking tube (20) to allow the braking tube (20) to rotate freely relative to the central axle (10).

The lower securing plate (15) is mounted on the bottom of the braking tube (20). The lower securing plate (15) has a diameter larger than that of the braking tube (20) and has multiple through holes (152) and securing members (153). The through holes (152) are defined through the lower securing plate (15) at a segment outside the braking tube (20) and are arranged in a circle. The securing members (153) are mounted respectively in through holes (152) and each have a shape tip for inserting into and holding a bottom of a strap reel (80).

In addition, a bushing (16) is mounted around the bottom of the central axle (10) between the central axle (10) and the lower securing plate (15) and has an annular lip (160) formed around and protruding from the bushing (16). With the lip (160) on the bushing (16), the lower securing plate (15) can be kept from contacting with the base (70) of the wrapping machine. Accordingly, the lower securing plate (15) is securely squeezed between the braking tube (20) and the lip (160) on the bushing (16).

The braking pad (25) is securely attached to and rotated with the top of the braking tube (20) and has a top.

The adjusting base (30) adjustably mounted on the central axle (10) and has a top, a bottom and a holding tube (32). The bottom of the adjusting base (30) abuts with the top of the braking pad (25). The holding tube (32) is formed on and protrudes from the top of the adjusting base (30).

The biasing member (35) is mounted around the top of the central axle (10) and is held inside the holding tube (32) on the adjusting base (30). The biasing member (35) may be a spring and has a top and a bottom abutting against the top of the adjusting base (30) to provide a biasing force to the adjusting base (30) against the braking pad (25).

The adjusting nut (40) has a threaded hole (41) screwed with the thread (12) on the top of the central axle (10) and abuts with the top of the biasing member (35).

The strap-holding collar (50) is mounted around the top of the central axle (10), may be around the holding tube (32) on the adjusting base (30) and has an annular abutting lip (52) for abutting against the top of the strap reel (80).

The upper holding base (60) is mounted around the top of the central axle (10) and may be mounted around the holding tube (32) between the holding tube (32) and the strap-holding collar (50). The upper holding base (60) has an abutting flange (62) formed around and protruding from the upper holding base (60) and mounted over the strap-holding collar (50). The upper holding base (60) further has a threaded hole (64) radially defined in the upper holding base (60), and a limiting bolt (65) is screwed into the threaded hole (64) in the upper holding base (60) and has an end abutting against the holding tube (32) on the adjusting base (30). With the abutment of the limiting bolt (65) with the holding tube (32), the upper holding base (30) can be securely held at a desired location.

In addition, a bearing (55) is mounted between the upper holding base (60) and the strap-holding collar (50) to allow the strap-holding collar (50) to rotate freely relative to the upper holding base (60).

With such an arrangement, a strap roll having a strap reeled around a strap reel (80) is mounted around the braking tube (20) and the strap reel (80) is inserted by the securing members (153) on the lower securing plate (15). The strap-holding collar (50) and the upper holding base (60) with the bearing (55) are attached to the top of the strap reel (80) of the strap roll and around the holding tube (32) on the adjusting base (30). After fastening the limiting bolt (65) against the holding tube (32), the strap roll is squeezed between the lower securing plate (15) and the strap-holding collar (52) and is rotated to release the strap from the reel (80) to strap objects or packages.

With the biasing force provided by the biasing member (35), a friction force is generated between the adjusting base (30) and the braking pad (25). With the friction force between the braking pad (25) and the adjusting base (30), the rotating speed of the strap roll squeezed between the lower securing plate (15) and the strap-holding collar (50) and the tightening strength of the strap can be controlled to desired levels.

Figure 4:
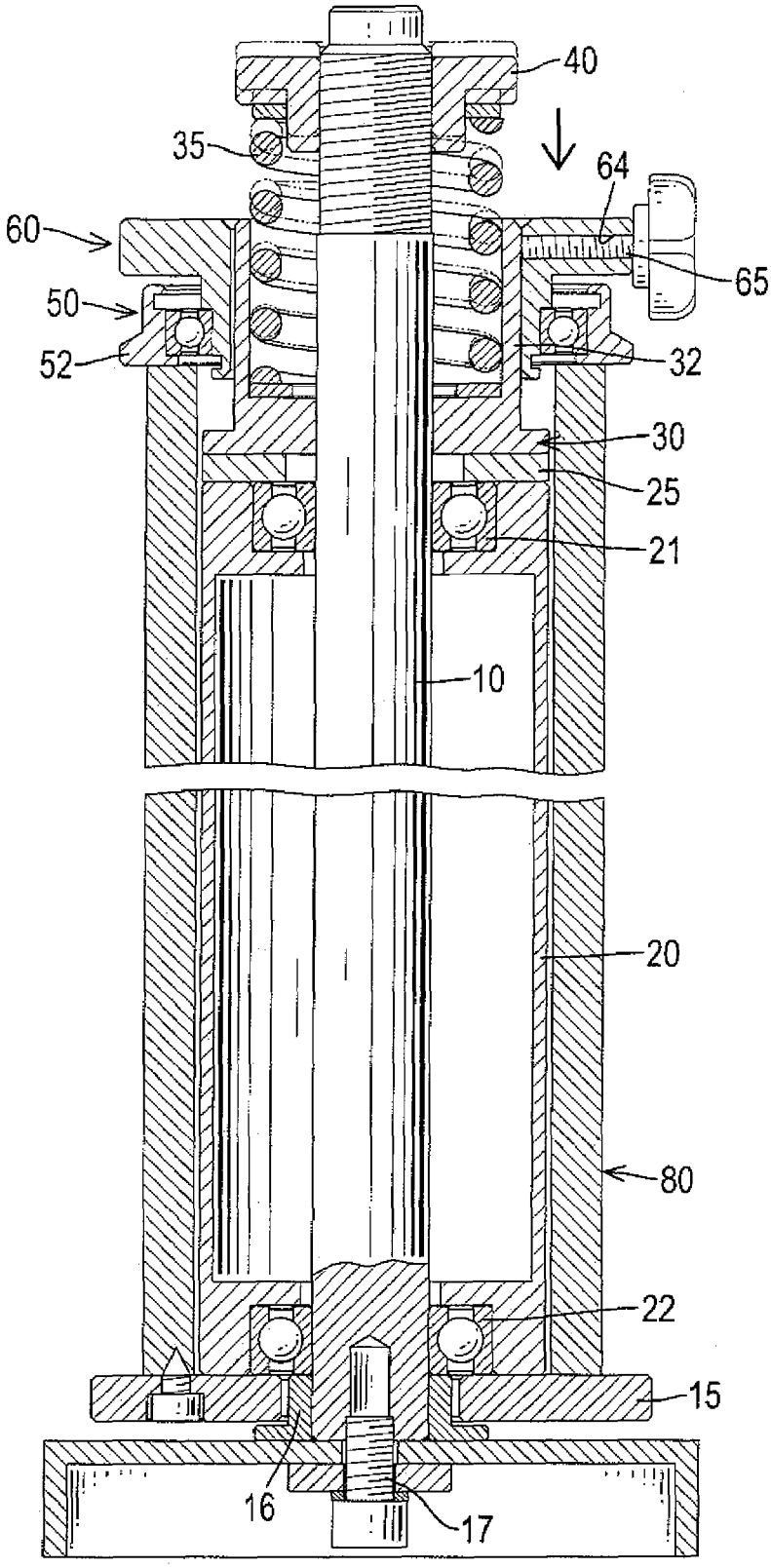
FIG. 4 is an operational side view in partial section of the strapping head assembly with the base in FIG. 1 showing that the strapping head assembly is adjusted.

With further reference to FIG. 4, after the limiting bolt (65) being loosened from the holding tube (32), the biasing member (35) will be further compressed or released by rotating the adjusting nut (40). Thus, the biasing force provided by the biasing member (35) will be changed, such that the friction force between the adjusting base (30) and the braking pad (25) can be adjusted. Consequently, the rotating speed of the strap roll is changed to provide different tightening strength to different straps with different thicknesses, so that the strapping head assembly can fit with different kinds of straps and is versatile in use. Because the tightening strength provided to the strap can be easily adjusted by rotating the adjusting nut (40), the strapping head assembly is convenient in use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A strapping head assembly for a wrapping machine comprising:

a central axle having a top, a bottom and a thread formed on the top;

a braking tube mounted rotatably around the central axle and having a top and a bottom;

a lower securing plate mounted on the bottom of the braking tube;

a braking pad attached to the top of the braking tube and having a top;

an adjusting base adjustably mounted on the central axle and having a top and a bottom abutting with the top of the braking pad;

a biasing member mounted around the top of the central axle and having a top and a bottom abutting against the top of the adjusting base to provide a biasing force to the adjusting base;

an adjusting nut screwed with the thread on the top of the central axle and abutting with the top of the biasing member;

a strap-holding collar mounted around the top of the central axle; and an upper holding base mounted around the top of the central axle and having an abutting flange formed around and protruding from the upper holding base and mounted over the strap-holding collar.

2. The strapping head assembly as claimed in claim 1, wherein the central axle further has an engaging block formed on and axially protruding from the bottom of the central axle.

3. The strapping head assembly as claimed in claim 2, wherein the lower securing plate has multiple securing members mounted on the lower securing plate for inserting into and holding a bottom of a strap reel.

4. The strapping head assembly as claimed in claim 3 further comprising a bushing mounted around the bottom of the central axle between the central axle and the lower securing plate and having an annular lip formed around and protruding from the bushing.

5. The strapping head assembly as claimed in claim 4, wherein the adjusting base further has a holding tube formed on and protruding from the top of the adjusting base and holding the biasing member inside;

the strap-holding collar is mounted around the holding tube;

the upper holding base is mounted around the holding tube between the holding tube and the strap-holding collar.

6. The strapping head assembly as claimed in claim 5 further comprising a bearing mounted between the upper holding base and the strap-holding collar.

7. The strapping head assembly as claimed in claim 6, wherein the upper holding base further has a threaded hole radially defined in the upper holding base; and a limiting bolt is screwed into the threaded hole in the upper holding base and has an end abutting against the holding tube on the adjusting base.

8. The strapping head assembly as claimed in claim 7, wherein the braking tube further has two bearings mounted around the central axle respectively at the top and bottom of the braking tube.

9. The strapping head assembly as claimed in claim 1, wherein the lower securing plate has multiple securing members mounted on the lower securing plate for inserting into and holding a bottom of a strap reel.

10. The strapping head assembly as claimed in claim 9 further comprising a bushing mounted around the bottom of the central axle between the central axle and the lower securing plate and having an annular lip formed around and protruding from the bushing.

11. The strapping head assembly as claimed in claim 10, wherein the adjusting base further has holding tube formed on and protruding from the top of the adjusting base and holding the biasing member inside;

the strap-holding collar is mounted around the holding tube;

the upper holding base is mounted around the holding tube between the holding tube and the strap-holding collar.

12. The strapping head assembly as claimed in claim 11 further comprising a bearing mounted between the upper holding base and the strap-holding collar.

13. The strapping head assembly as claimed in claim 12, wherein the upper holding base further has a threaded hole radially defined in the upper holding base; and a limiting bolt is screwed into the threaded hole in the upper holding base and has an end abutting against the holding tube on the adjusting base.

14. The strapping head assembly as claimed in claim 13, wherein the braking tube further has two bearings mounted around the central axle respectively at the top and bottom of the braking tube.

15. The strapping head assembly as claimed in claim 1 further comprising a bushing mounted around the bottom of the central axle between the central axle and the lower securing plate and having an annular lip formed around and protruding from the bushing.

16. The strapping head assembly as claimed in claim 1, wherein the adjusting base further has holding tube formed on and protruding from the top of the adjusting base and holding the biasing member inside;

the strap-holding collar is mounted around the holding tube;

the upper holding base is mounted around the holding tube between the holding tube and the strap-holding collar.

17. The strapping head assembly as claimed in claim 16, wherein the upper holding base further has a threaded hole radially defined in the upper holding base; and a limiting bolt is screwed into the threaded hole in the upper holding base and has an end abutting against the holding tube on the adjusting base.

18. The strapping head assembly as claimed in claim 1 further comprising a bearing mounted between the upper holding base and the strap-holding collar.

19. The strapping head assembly as claimed in claim 1, wherein the braking tube further has two bearings mounted around the central axle respectively at the top and bottom of the braking tube.

20. The strapping head assembly as claimed in claim 1, wherein the upper holding base further has a threaded hole radially defined in the upper holding base; and a limiting bolt is screwed into the threaded hole in the upper holding base and has an end abutting against the adjusting base.

* * * * *